US008720247B2

(12) United States Patent
Otsubo et al.

(10) Patent No.: US 8,720,247 B2
(45) Date of Patent: May 13, 2014

(54) METHOD FOR BENDING PROCESS AND PROCESSING MACHINE

(75) Inventors: Hidemasa Otsubo, Obu (JP); Kazuhiro Mitsukawa, Ichinomiya (JP); Tomohiro Shiomi, Nagoya (JP)

(73) Assignee: Denso Corporation, Kariya (JP)

( * ) Notice: Subject to any disclaimer, the term of this patent is extended or adjusted under 35 U.S.C. 154(b) by 289 days.

(21) Appl. No.: 13/302,209

(22) Filed: Nov. 22, 2011

(65) Prior Publication Data

US 2013/0125609 A1 May 23, 2013

(51) Int. Cl.
*B21D 13/02* (2006.01)

(52) U.S. Cl.
USPC ..... 72/379.6; 72/385; 72/412; 72/416; 72/472

(58) Field of Classification Search
USPC ..... 72/379.6, 380, 381, 385, 412, 414, 416, 72/472, 475
See application file for complete search history.

(56) References Cited

U.S. PATENT DOCUMENTS

| | | | | |
|---|---|---|---|---|
| 3,307,387 | A * | 3/1967 | Lacey, Jr. et al. | 72/324 |
| 7,024,907 | B2 * | 4/2006 | Beauvois et al. | 72/385 |
| 8,082,770 | B2 * | 12/2011 | Bowman et al. | 72/385 |
| 2006/0193939 | A1 | 8/2006 | Ohtsuka et al. | |

FOREIGN PATENT DOCUMENTS

| | | |
|---|---|---|
| JP | S46-042607 | 12/1971 |
| JP | 04-162364 | 6/1992 |
| JP | 04-371322 | 12/1992 |
| JP | 9-155460 | 6/1997 |
| JP | 11-179438 | 7/1999 |
| JP | 2002-224752 | 3/2002 |
| JP | 2003-094134 | 4/2003 |
| JP | 2003-115567 | 4/2003 |
| JP | 2006-15388 | 1/2006 |
| JP | 2006-136896 | 6/2006 |
| JP | 2006-263815 | 10/2006 |
| JP | 2008-087033 | 4/2008 |
| JP | 2009-078276 | 4/2009 |

OTHER PUBLICATIONS

Office action dated Jun. 25, 2013 in corresponding Japanese Application No. 2009-119123 with English translation.
Office Action mailed Dec. 10, 2013 in corresponding JP Application No. 2009-119123 with English translation.

* cited by examiner

*Primary Examiner* — David B Jones
(74) *Attorney, Agent, or Firm* — Harness, Dickey & Pierce, PLC

(57) ABSTRACT

Multiple movable die portions (press punches) are respectively opposing to multiple fixed die portions (block members). Each of the press punches is sequentially pushed down with a predetermined time difference to the corresponding block member to continuously carry out press work to a material inserted into a press-work area between the press punches and the block members. A clearance is formed between a forward end of the press punch and a forward end of the block member at a position shortly before a press-work operating position in order to control a pulling force of the material, so that a shape distortion can be avoided.

4 Claims, 5 Drawing Sheets

METHOD FOR BENDING PROCESS AND PROCESSING MACHINE

CROSS REFERENCE TO RELATED APPLICATION

This application is based on Japanese Patent Application No. 2009-119123 filed on May 15, 2009, the disclosure of which is incorporated herein by reference.

FIELD OF THE INVENTION

The present invention relates to a method for a bending process and a processing machine thereof, which is preferably applied to, for example, a manufacturing process of a corrugated fin for a heat exchanger.

BACKGROUND OF THE INVENTION

A bending process for a corrugated product is known in the art, for example, as disclosed in the following patent publications:

Patent Publication No. 1: JP Patent Publication No. 2008-087033;

Patent Publication No. 2: JP Patent Publication No. 2006-136896;

Patent Publication No. 3: JP Patent Publication No. 2003-115567;

Patent Publication No. 4: JP Patent Publication No. 2006-015388;

Patent Publication No. 5: JP Patent Publication No. H11-179438;

Patent Publication No. 6: JP Patent Publication No. H09-155460.

According to one of conventional machines for the bending process, for example, as shown in FIG. 7 attached to the present application, multiple fixed dies 1, each of which has a recess Cm at a forward end for carrying out a press work so as to form a material M in a corrugated shape, are arranged in a line neighboring to each other. In a similar manner, multiple movable dies (press punches) 2, each of which has a punching forward end and is operatively punched into the respective recesses Cm, are arranged in a line neighboring to each other. According to the above processing machine, the multiple press punches 2 are simultaneously pushed down to the material M inserted into a working space between the fixed dies 1 and the movable dies 2, so as to carry out the press work and to form the material M in a corrugated shapes.

According to another prior art method for forming multiple corrugated portions by one press work, for example, as disclosed in the Patent Publication No. 1 (JP 2008-087033), a corrugated portion formed in a strip metal plate is held by a temporal holding portion, and then further corrugated portions (two corrugated portions) are sequentially formed by one press work in the strip metal plate in a direction from the temporarily held corrugated portion toward a material feeding portion. As above, the multiple corrugated portions are sequentially formed one after another in one press work.

According to a further prior art, for example, as shown in FIG. 8 attached to the present application, a corrugated portion is formed in a strip metal plate one by one in order to avoid a breaking of material. According to the machine and method for the bending process, multiple fixed dies 1 each having a recess Cm are arranged in a line in which the fixed dies are neighboring to each other. Multiple punches 2 are sequentially moved down toward the fixed dies 1 one by one, while the material M is fed to a press work area between the fixed dies and punches, so as to carry out the press work. More in detail, a corrugated portion is formed in the material M at a first press work point, the press punch 2 is lifted up so that the material M is further fed until the corrugated portion processed at the first press work point is moved to a second press work point, and another press punch 2 neighboring to the first press work point is pushed down to the fixed die 1 so as to surely keep the corrugated shape. During the press work at the second press work point, a portion of the material M is further pulled into the second press work point (the recess Cm of the fixed die 1).

The corrugated shape of the material M is likely to restore to its original flat shape to some extent by its elasticity, when the material M is processed by the press work at the first press work point. According to the above method, the press work is further carried out to the corrugated portion at the second press work point, so that the corrugated shape of the material M is maintained.

In a case that a larger number of corrugated portions will be formed, it will be necessary to carry out the press work at a higher speed. A method for forming multiple corrugated portions is proposed in the art, according to which multiple corrugated portions are formed in one stroke with time differences between respective press works. For example, as shown in FIG. 9 or 10, multiple press punches 2 are arranged in a line and a movable cam 3 is moved in a direction along the line of the press punches 2. The movable cam 3 has a pressing surface at its forward end, wherein the pressing surface is inclined by 45 degrees with respect to the moving direction of the movable cam 3. Therefore, when the movable cam 3 is moved in the forward direction, each of the press punches 2 is sequentially pushed down in a predetermined stroke "d", so that the press work is carried out to the material M to form the corrugated shape. The above explained method is disclosed, for example, in the Patent Publication No. 2 (JP 2006-436896).

A further method for forming multiple corrugated portions is known in the art, for example, as disclosed in the Patent Publication No. 3 (JP 2003-115567), according to which multiple first punches and multiple second punches are arranged in a comb-shaped condition so that the first and second punches are opposing to each other. According to the prior art, a corrugated fin having a rectangular cross section is manufacture.

According to the Patent Publication No. 4 (JP 2006-15388), each of two press punches is alternately moved up and down so as to continuously manufacture a concavo-convex fin having a rectangular cross section from a flat thin metal plate.

Furthermore, a method for alternately moving two press punches up and down is disclosed in the Patent Publication No. 6 (JP H09-155960).

According to the Patent Publication No. 5 (JP H11-179438), upper and lower press punches are alternately operated in a sequential manner having a time difference between alternate operations of the upper and lower press punches, so as to carry out press works to a strip metal plate.

According to the conventional method, for example, as disclosed in the Patent Publication No. 1, the multiple corrugated portions can be formed by one press work in order to increase a working efficiency. However, it may have a problem that the breaking of the material or a shape distortion (such as a bowing of a product as shown in FIG. 11 attached to the present application) may occur.

According to the other convention method, for example, as disclosed in the Patent Publication No. 2, it is possible to continuously form the multiple corrugated portions by the movement of the movable cam. The movable cam 3 has the pressing surface at its forward end, wherein the pressing surface is inclined by 45 degrees with respect to the moving direction of the movable cam 3. Each of the press punches 2 are moved down by the predetermined stroke "d", when the movable cam 3 is operated in the forward direction. However, an aspect ratio of the stoke "d" with respect to a width "P" of the press punch 2 is generally smaller than 1. In other words, a direction of movement of the cam 3 is in parallel to the line in which the multiple press punches are arranged, that is, the width direction of the press punches. Therefore, even when the pressing surface of the movable cam 3 having the 45-degree inclined surface is moved by the width "P", the stroke "d" of the press punch 2 is smaller than "P" (P>d). As a result, in case of the material having a large aspect ratio or a high Young's modulus, the shape distortion may occur.

According to the Patent Publications Nos. 3 to 6, the upper dies and lower dies are moved up and down with the time differences. However, nothing is disclosed in the above prior art about the material having the large aspect ratio or the high Young's modulus.

A further proposal is made as shown in FIG. 12 attached to the present application, according to which a movable cam 3 is so arranged that the movable cam 3 is movable relative to a press punch 2 along a longitudinal direction of the press punch 2. The movable cam 3 has an inclined surface portion at its forward end, wherein the inclined surface portion is inclined by 45 degrees with respect to the longitudinal direction of the press punch 2. According to such an arrangement, a stroke of the press punch 2 in the downward direction is increased.

According to the above structure, however, since only a one side of the press punch 2, that is, a rear side end of the press punch 2 is in contact with the movable cam 3 (so-called a one-side contacting condition), a forward end of the press punch 2 may be lifted up.

SUMMARY OF THE INVENTION

The present invention is made in view of the above problems. It is an object of the present invention to provide a bending process and a processing machine, according to which multiple press punches are sequentially moved with a time difference in order to carry out press works to a thin metal plate, so that a product of a corrugated shape having no breaking and/or bowing of material can be manufactured.

According to a feature of the present invention, a bending machine has a first and a second die unit opposing to each other for bending a material of a thin metal plate. The first die unit includes multiple first die portions, each of which has a forward end for a bending process and is neighboring to each other in a direction of movement of the material. The second die unit includes multiple second die portions, each of which has a forward end for the bending process and is neighboring to each other in the direction of movement of the material. Each of the first die portions is opposing to each of the second die portions to form a pair of the first and second die portions. Each pair of the first and second die portions is sequentially operated so that at least one of the first and second die portions is relatively moved toward the other die portion, in order to continuously carry out the bending process so as to form the material in a corrugated shape. A method for the bending process comprises:

a step for feeding the material toward a press work area between the first and second die units;

a step for relatively moving the second die portion toward the first die portion so as to form a clearance between the forward ends of the first and second die portions at a material feeding position shortly before a press-work operating position for the bending process; and a step for carrying out the bending process to the material at the press-work operating position, wherein a pulling force of the material during the bending process is controlled by the clearance.

According to the above feature, a shape distortion of the material (such as bowing, breaking or the like) at the material feeding position, which is shortly before the press-work operating position by the first and second die portions, can be prevented.

According to another feature of the present invention, a bending machine has a first and a second die unit opposing to each other for bending a material of a thin metal plate, the material being fed toward a press work area between the first and second die units. The first die unit includes multiple die portions, each of which has a forward end for a bending process and is neighboring to each other in a direction of movement of the material. The second die unit includes multiple second die portions, each of which has a forward end for the bending process and is neighboring to each other in the direction of movement of the material. Each of the first die portions is opposing to each of the second die portions to form a pair of the first and second die portions, and each pair of the first and second die portions being sequentially operated so that at least one of the first and second die portions is relatively moved toward the other die portion, in order to continuously carry out the bending process so as to form the material in a corrugated shape. In the bending machine, a clearance is formed between the forward ends of the first and second die portions at a material feeding position shortly before a press-work operating position for the bending process, when the second die portion is relatively moved toward the first die portion, so as to control a pulling force of the material during the bending process.

According to the above feature, an excessive external force can not be applied to the material, so that a shape distortion of the material (such as bowing, breaking or the like) can be prevented.

According to a further feature of the present invention, a bending machine has a first and a second die unit opposing to each other for bending a material of a thin metal plate. The first die unit includes multiple first die portions, each of which has a forward end for a bending process and is neighboring to each other in a direction of movement of the material. The second die unit includes multiple pairs of a cam member and a press punch having a forward end for the bending process. The press punch is neighboring to each other in the direction of movement of the material, and has a width in the direction of movement of the material. Each pair of the cam member and the press punch is sequentially operated so that the press punch is relatively moved toward the first die portion, in order to continuously carry out the bending process so as to form the material in a corrugated shape. A method for the bending process comprises:

a step for feeding the material toward a press work area between the first and second die units;

a step of sequentially moving the cam members of the second die unit in a cam operating direction, which is perpendicular to the direction of movement of the material, so that the press punches are sequentially pushed toward the first die portions in a predetermined stroke in order to carry out the bending process to the material, wherein the width of the press punch is smaller than the predetermined stroke thereof.

According to the above feature of the invention, the press punch can be moved in the larger stroke with a simple structure, so that a product having a higher aspect ratio can be manufactured.

According to a still further feature of the present invention, a bending machine has a first and a second die unit opposing to each other for bending a material of a thin metal plate, the material being fed toward a press work area between the first and second die units. The first die unit includes multiple first die portions, each of which has a forward end for a bending process and is neighboring to each other in a direction of movement of the material. The second die unit includes multiple pairs of a cam member and a press punch having a forward end for the bending process, and the press punches are neighboring to each other in the direction of movement of the material. Each pair of the cam member and the press punch of the second die unit is sequentially operated so that the press punch is relatively moved toward the first die portion, in order to continuously carry out the bending process so as to form the material in a corrugated shape. The press punch has a width in the direction of movement of the material. The cam member is movable in a cam operating direction, which is perpendicular to the direction of movement of the material. Each of the cam members is operatively brought into and out of engagement with each of the press punches via multiple inclined engaging portions, so that the press punch is pushed toward the first die portion when the cam member is moved in the cam operating direction in a predetermined stroke, wherein the width of the press punch is smaller than the predetermined stroke thereof.

According to the above feature, the cam member is arranged to be movable to the press punch in the longitudinal direction of press punch and the cam member is operatively engaged with or disengaged from the press punch via the multiple inclined engaging portions. Therefore, the press punch can be moved up and down with a simple structure and a lift-up of the press punch caused by the one-side contacting condition can be avoided.

According to a still further feature of the present invention, a bending machine has a first and a second die unit opposing to each other for bending a material of a thin metal plate. The first die unit includes multiple first cam members and multiple first press punches, and the first press punches are neighboring to each other and straightly arranged in a longitudinal direction of the material. Each of the first cam members is operatively brought into and out of engagement with each of the first press punches, so that the first press punch is moved toward the second die unit when the first cam member is operated The second die unit includes multiple second cam members and multiple second press punches, and the second press punches are neighboring to each other and straightly arranged in the longitudinal direction of the material. Each of the second cam members is operatively brought into and out of engagement with each of the second press punches, so that the second press punch is moved toward the first die unit when the second cam member is operated. A method for the bending process comprises:

a step for feeding the material toward a press work area between the first and second die units; and a step of sequentially operating the respective first and second cam members of the first and second die units in a cam operating direction, which is perpendicular to the longitudinal direction of the material, so that the respective press punches are sequentially pushed to each other in a punch operating direction, which is perpendicular to a plane of the material, in order to continuously carry out the bending process to the material and to thereby form the material in a corrugated shape.

According to the above feature, the material is interposed between the first and second press punches and each of the first and second press punches is opposing to each other. Each of the first and second cam members is moved along the respective longitudinal directions of the first and second press punches so that the first and second press punches are moved in the punch operating direction to continuously carry out the press work to the material.

According to a still further feature of the present invention, in the step of sequentially operating the respective first and second cam members of the first and second die units in the cam operating direction, first and second center cam members, which are respectively arranged in a center of the straightly arranged first and second cam members, are operated at first, and first and second cam members neighboring to and arranged at both sides of the first and second center cam members are sequentially operated in a symmetric manner.

According to the above feature, the external force to be applied to the material may not be unevenly distributed, and thereby it is possible to manufacture the product having little shape distortion, such as the bowing or the like.

According to a still further feature of the present invention, a bending machine has a first and a second die unit opposing to each for bending a material of a thin metal plate. The first die unit includes multiple first cam members and multiple first press punches, and the first press punches are neighboring to each other and straightly arranged in a longitudinal direction of the material. The second die unit includes multiple second cam members and multiple second press punches, and the second press punches are neighboring to each other and straightly arranged in the longitudinal direction of the material. Each of the first and second cam members are movable in a cam operating direction, which is perpendicular to the longitudinal direction of the material. Each of the first cam members is operatively brought into and out of engagement with each of the first press punches via an inclined engaging portion, so that the first press punch is pushed toward the second die unit in a punch operating direction perpendicular to a plane of the material, when the first cam member is moved in the cam operating direction. Each of the second cam members is operatively brought into and out of engagement with each of the second press punches via an inclined engaging portion, so that the second press punch is pushed toward the first die unit in the punch operating direction, when the second cam member is moved in the cam operating direction. The respective first and second cam members are sequentially operated, so that the respective press punches are sequentially pushed to each other in order to continuously carry out the bending process to the material and to thereby form the material in a corrugated shape.

According to the above feature, the material is interposed between the first and second press punches and each of the first and second press punches is opposing to each other. Each of the first and second cam members is moved along the respective longitudinal directions of the first and second press punches, so that each of the cam members is brought into and out of the engagement with each of the press punches via the respective inclined engaging portions. As a result, the first and second press punches are sequentially moved to the other so as to continuously carry out the bending process to the material.

According to a still further feature of the present invention, the method for the bending process further comprises a step of carrying out a finishing bending process in order to keep the corrugated shape of the material, after the step for carrying out the bending process to the material at the press-work operating position.

According to the above feature, even in a case that the material is partly restored to its original shape by its elasticity, the shape of the corrugated product can be assured by carrying out an additional step of the finishing bending process to the entire area for the bending process.

According to a still further feature of the present invention, the method for the bending process further comprises a step of carrying out a primary bending process to the material, before the step for feeding the material toward the press work area between the first and second die units.

According to the above feature, even in a case that the material is partly restored to its original shape by its elasticity, the shape of the corrugated product can be stably obtained by the primary bending process and its subsequent (secondary) bending process.

According to the present invention, the product of the corrugated shape can be obtained, according to which deficiency (such as the bowing, the breaking or the like) of the material may not be generated in the bending process to form the material in the waveform.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

First Embodiment

A first embodiment of the present invention for a method for a bending process will be explained with reference to the drawings. A thin metal plate, which can be easily and plastically deformed, is used as a material to be processed.

Such a material, which has relatively a small specific gravity and which is flexible, capable of plastic deformation and malleable (for example, a light metal such as aluminum) is used as the thin metal plate.

In the present embodiment, an example for manufacturing a corrugated fin, which is used in a radiator for a vehicle engine, will be explained.

The corrugated fin is made of metal plate and formed in a waveform, wherein the wave-formed portions (the corrugated portions) are arranged at equal intervals. The corrugated fins are arranged between neighboring tubes, through which working fluid (such as, engine cooling water, refrigerant or the like) flows, so as to enhance radiation of heat from the working fluid flowing in the tubes to the surrounding air. A material for the corrugated fin, for example, a rolled thin metal plate, is pulled out from a roll and pulled into a processing machine, so that the corrugated fins are manufactured.

A processing machine is known in the art, for example, as disclosed in the Patent Publication No. 1 (JP 2008-087033), according to which a material to be processed is wound in a roll shape.

The processing machine of this kind has a feeding portion for feeding the material to be processed from the roll and a processing portion for forming the fed-in material into the waveform.

As explained below, the feeding portion feeds such an amount of the material to be processed, which corresponds to a predetermined number of the waveforms to be processed by one cycle of a bending process.

Figure 1:
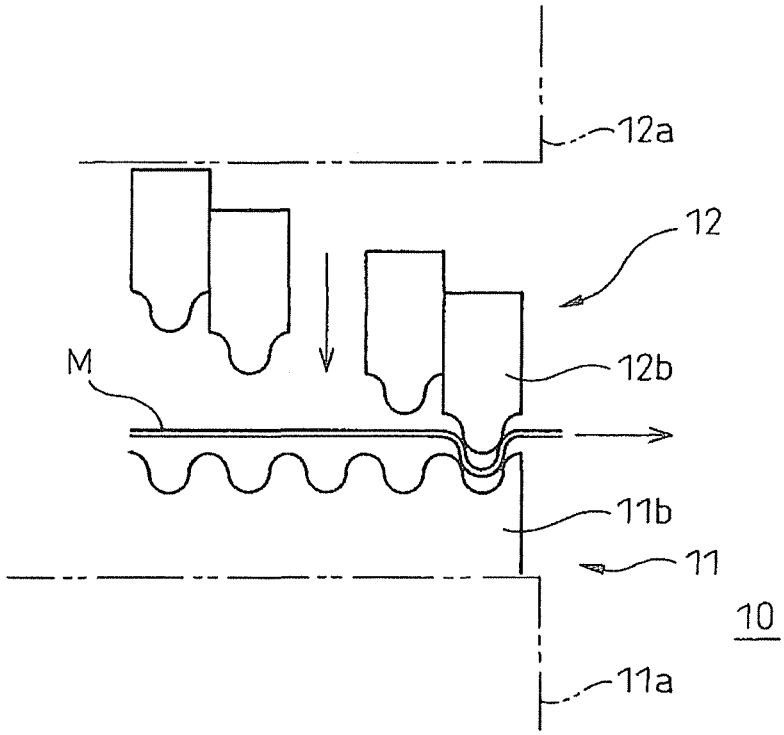
FIG. 1 is a schematic view showing a bending process according to a first embodiment of the present invention.

As shown in FIG. 1, a processing machine 10 has a first die unit 11 and a second die unit 12 opposing to each other. Each of the first and second die units has multiple die portions 11*b* and 12*b* to form multiple pairs of first die portions 11*b* and second die portions 12*b*, each of which has a bending process portion at its forward end. A material M (a thin metal plate) to be processed will be fed to a press work area, which is a space between the first and second die units 11 and 12. In each pair of the first and second die portions 11*b* and 12*b*, the second die portion 12*b* is movable relative to the first die portion 11*b*. And such relative movement of the second die portion 12*b* to the first die portion 11*b* is carried out in a sequential order, so that the bending process for the thin metal plate M into the waveform is continuously carried out.

In the present embodiment, the first die unit 11 is composed of the multiple first die portions (block members) 11*b* supported by a lower die 11*a*, while the second die unit 12 is composed of multiple second die portions (press punches) 12*b* supported by an upper die 12*a*.

The multiple first die portions (the block members) 11*b* are continuously arranged on the lower die 11*a*, wherein each of the block members 11*b* forms a receiving side for processing the material (the thin metal plate) M into the waveform. In each of the block members 11*b*, a concave portion is formed at its forward end for the bending process, that is, a bending process surface.

In a similar manner, the multiple second die portions (press punches) 12*b* are continuously arranged at the upper die 12*e*. Each of the press punches 12*b* is downwardly moved toward the bending process surface of the block member 11*b* of the lower die 11*a*, so that a pressing force of a predetermined value is applied to the material (the thin metal plate) M in order to plastically deform it into the waveforms.

The press punches 12*b* are operated to move downwardly by a die operating mechanism (not shown) provided at the upper die 12*a*, in such a manner that each of the press punches 12*b* is downwardly moved one after the other with a predetermined time difference so as to carry out the bending process (the press work). In this operation of the press punches 12*b*, a timing for moving down the respective press punch 12*b* is adjusted depending on a speed for feeding the material M, an aspect ratio and so on.

In the embodiment shown in FIG. 1, among the respective neighboring press punches 12*b*, the press punch 12*b* which is located at a downstream side (at a right-hand end in FIG. 1) in a feeding direction of the material M is operated at first. Then, the press punch 12*b* neighboring to the press punch 12*b* of the right-hand end, which has been moved downwardly at first, is moved downwardly with the predetermined time difference (a predetermined time lag).

According to the processing machine 10, the material M is fed to the press work area between the lower die 11*a* and the upper die 12*a* in such a manner that the thin metal plate M is distanced from the forward end of the block member 11*b* of the lower die 11*a* with a clearance C as explained below.

Figure 2:
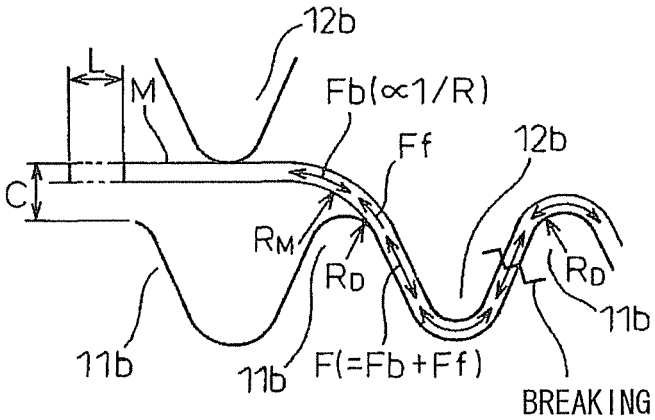
FIG. 2 is a schematic view for explaining processing conditions between a press punch and a die when carrying out a method for the bending process of the present invention.

In the above press work, in addition to the adjustment of the move-down timing of the respective press punches 12*b*, a processing curvature radius R is controlled by way of a curvature radius Rm of a single-side bending process by the press punch 12*b*, in order to carryout the press work in a favorable condition. Stabilization of processed (finished) shape of the final product (for example, the corrugated fins) is realized based on the following parameters (FIG. 2).

$R_D$: a curvature radius at the forward end at the bending process surface of the block member 11*b;*

Fb: a bending resistance (which is in an inverse proportion to R);

Ff: a frictional force between the forward end of the bending process surface and the material M;

L: a pull-in amount of the material M (which is in proportion to F);

C: a clearance between the press punch 12*b* and the forward end of the block member 11*b* (the bending process surface);

F: a tensility (a pulling force) (F=Fb+Ff).

The clearance C is a distance between the press punch 12*b* and the forward end of the block member 11*b* at a position shortly before a press work position. As a result of existence of the clearance C, the pull-in, amount L of the material M can be controlled by the tensility F which is generated in the material M during the press work, wherein the tensility F is based on the frictional force Ff and the bending resistance Fb. Accordingly, the press work can be carried out in a favorable manner without causing a breaking in the material M.

A process of the press work, which is carried out by the above explained processing machine 10, will be explained.

The upper die 12*a* of the processing machine 10 moves up and down relative to the lower die 11*a* between a lower-most position in which the upper die 12*a* is closed to the lower die 11*a* and an upper-most position in which the upper die 12*a* is opened from the lower die 11*a*. Each of the press punches 12*b* is moved downwardly one after the other with the predetermined time difference by the die operating mechanism (not shown) fixed to the upper die 12*a*, so as to carry our the press work to the material (thin metal plate) M.

As shown in FIG. 2, the clearance C is formed between each forward end of the first and second dies 11 and 12 at such a position shortly before starting the press work, so as to control the pull-in amount L of the material M.

When the press punch 12*b* is moved downwardly by the die operating mechanism at a press-work operating position, a portion of the material M to be processed is interposed between the press punch 12*b* and the forward end of the block member 11*b* of the lower die 11.

At the position shortly before starting the press work, since the clearance C is formed between the press punch 12*b* and the forward end of the block member 11*b* of the lower die 11, the material M is bent against the bending resistance Fb from the forward end of the block member 11*b* (which is in the press-work operation) in such a shape having the curvature radius Rm in the single-side bending condition.

At the press-work operating position, the bending resistance Fb and the tensility F based on the frictional force Ff are applied to the material M (more exactly, to a portion of the material M to be press worked). As a result, the material M is pulled into a press-working portion between the upper and lower dies (11*b*, 12*b*) by the pull-in amount L, which is in proportion to the tensility F.

As above, the press-work operation is sequentially carried out, wherein the clearance C is formed between the press punch 12*b* and the forward end of the block member 11*b* at the position shortly before starting the press work so as to control the pull-in amount of the material M depending on the tensility F. As a result, the material (the thin metal plate) M is formed in a desired wave form without causing the breaking in the material M.

A dimension of the clearance C is preferably smaller than a height of the corrugated portion (i.e. a height of the waveform).

Second Embodiment

Figure 3:
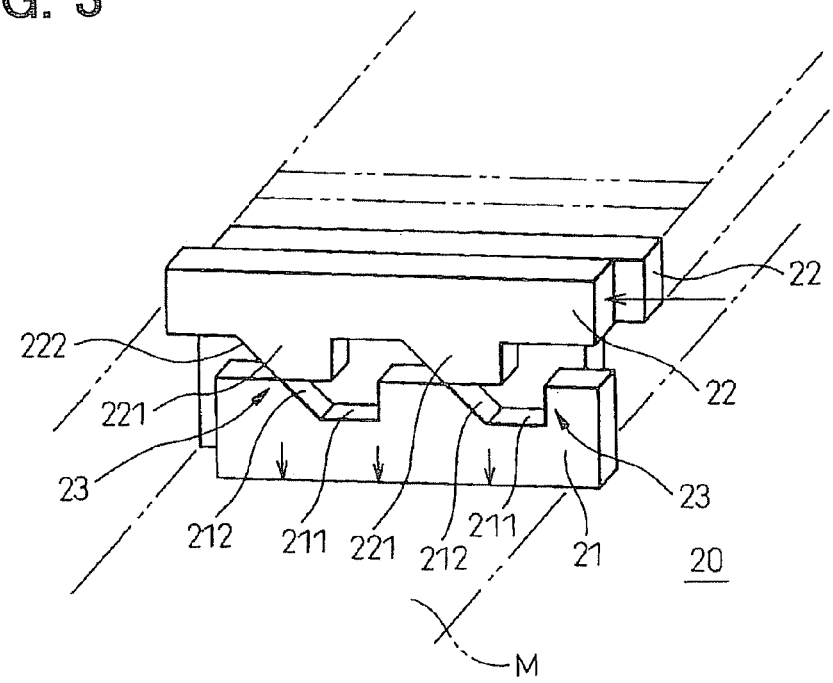
FIG. 3 is a schematic perspective view showing relevant portions for carrying out a method of a bending process according to a second embodiment of the present invention.

A processing machine 20 of a second embodiment is shown in FIG. 3. According to the processing machine 20, a movable cam is moved in a cam operating direction, which is perpendicular to a direction of movement of the material M, in order to move the press punch in a punch operating direction, which is a direction perpendicular to the plane of the material M. More in detail, the movable cam is moved at a back side (an upper side in FIGS. 3 and 4) of the press punch in the cam operating direction, so that the press punch is pushed down by a pushing surface of the movable cam. The pushing surface is inclined at an angle of about 45 degree with respect to a line of the cam operating direction.

The processing machine 20 has multiple movable dies 21 (the press punches) neighboring to each other, each of which is movable in the punch operating direction perpendicular to the plane of the material M. Although not shown in the drawing, the processing machine 20 has a lower die similar to that of the first embodiment, so that each of the movable dies (the press punches) 21 is opposing to each forward end of the respective block members of the lower die to form multiple pairs of the upper and lower dies. Furthermore, the processing machine 20 has multiple cam members 22 neighboring to each other, each of which is operatively engaged with the respective movable die 21. The cam member 22 is movable relative to the movable die 21 in the cam operating direction perpendicular to the direction of movement of the material M. The neighboring cam members 22 are sequentially moved in the cam operating direction.

Each of the movable dies 21 and cam members 22 has multiple inclined engaging portions 23. When the cam member 22 is moved in the cam operating direction, the movable die 21 is pushed downwardly along the inclined engaging portions 23. The movable die 21 is downwardly moved by a predetermined stroke so as to carry out the press work to the material (the thin metal plate) M.

Each of the movable dies (the press punches) 21 is arranged in such a way that a longitudinal direction of the movable die 21 is directed in a width direction of the material M, which is perpendicular to the direction of movement of the material M. A length of the movable die 21 is almost equal to a width of the material (the thin metal plate of a strip shape) M. Each of the movable dies 21 is independently movable from the neighboring movable dies 21.

The cam member 22 is generally engaged with the movable die 21 via the inclined engaging portions 23 and the cam member 22 is brought out of engagement from the movable die 21 when the cam member 22 is moved to its maximum stroke position.

As explained above, the lower die (not shown) is provided below the material M. The lower die, which may be composed of multiple block members like the first embodiment, has a bending process surface of a rectangular waveform in cross section.

Figure 4:
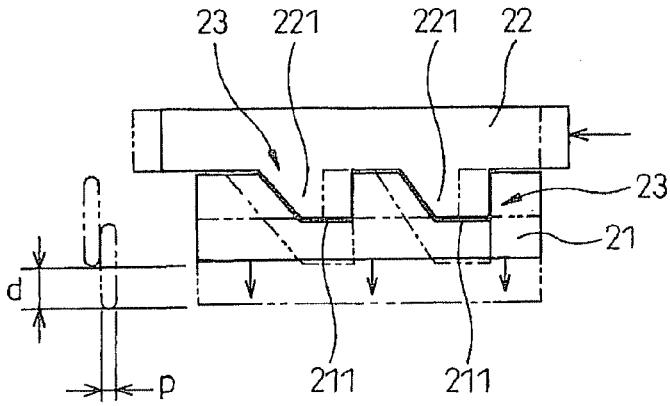
FIG. 4 is a schematic view showing the relevant portions (a press punch and a movable cam) of a machine shown in FIG. 3.

As shown in FIGS. 3 and 4, a pair of concave portions 211 is formed on an upper side of the movable die 21, while a pair of convex portions 221 is formed on a lower side of the cam member 22, wherein the convex portions 221 are engaged with the concave portions 211 to form the inclined engaging portions 23. More in detail, inclined surfaces 212 are formed in the movable die 21 at the concave portions 211, while inclined surfaces 222 are formed in the cam member 22 at the convex portions 221, wherein the inclined surfaces 222 are respectively brought into contact with the inclined surfaces 212. The inclined surfaces 212 and 222 are inclined with respect to the cam operating direction (that is, a longitudinal direction of the cam member 22) by 135 degrees in an anticlockwise direction (that is, 45 degrees in a clockwise direction).

According to the above structure, when the cam member 22 is moved in the cam operating direction (in a leftward direction in the drawings), the movable die 21 is pushed downwardly along the inclined surfaces 222 of the cam member 22, so that the movable die 21 is moved downwardly by a stroke "d". A thickness of the movable die (the press punch) 21 is "p", so that an aspect ratio is "d/p". Since the stroke "d" is larger than the thickness "p", the aspect ratio "d/p" becomes larger than "1" (d/p>1).

According to the processing machine 20 of the second embodiment, the cam member 22 is movably arranged in the cam operating direction, which is perpendicular to the direction of the movement of the material M, in order that the movable die (the press punch) 21 is moved in the punch operating direction, which is perpendicular to the plane of the material M, by the stroke "d".

When compared with the conventional processing machine, in which a cam member is moved in a direction along a direction of movement of a material, the aspect ratio of the present embodiment becomes larger than that of the conventional machine. Therefore, it is possible to sequentially move the multiple press punches 21 in a larger stroke than that of the conventional machine to form the corrugated shape.

Figure 12:
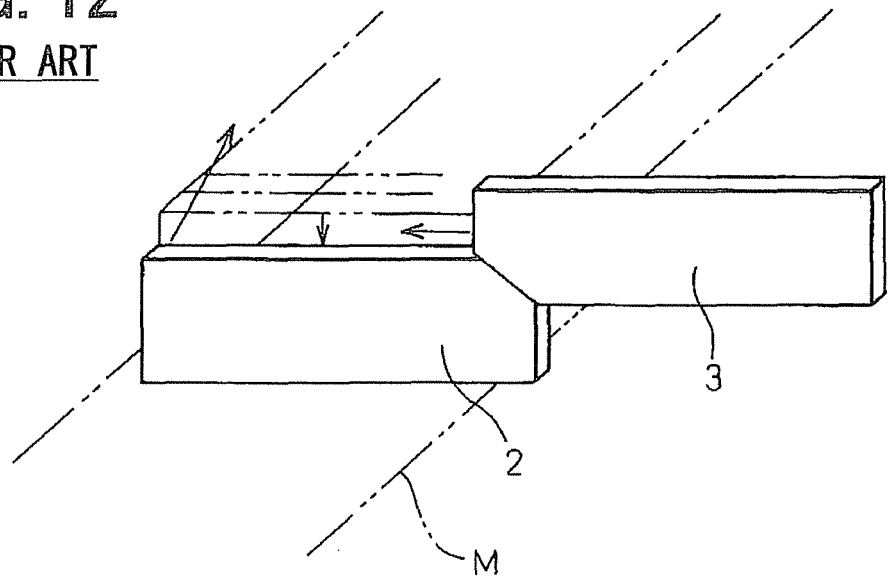
FIG. 12 PRIOR ART
FIG. 12 is a schematic perspective view for explaining another time-difference press work according to a prior art.

In addition, the cam member 22 is brought into and/or out of engagement with the movable die (the press punch) 21 via the pair of the concave portions 211 formed in the press punch 21 and the pair of the convex portions 221 formed in the movable cam 22, and the cam member 22 is moved in the cam operating direction so that the press punch 21 is downwardly pushed by the inclined engaging portions 23, which has the inclined surfaces 212 and 222 inclined by 135 degrees from the cam operating direction in the anticlockwise direction. Therefore, when compared with the conventional machine, for example, as shown in FIG. 12, in which the movable cam 3 is in contact with the press punch 2 at a single engaging portion, the cam member 22 of the present embodiment is brought into contact with the movable die 21 at two inclined engaging portions 23. As a result, according to the present embodiment, it is possible to suppress a lifting movement of the press punch 21 which may be caused by a single-point contact between the movable cam 3 and the press punch 2.

Third Embodiment

Figure 5:
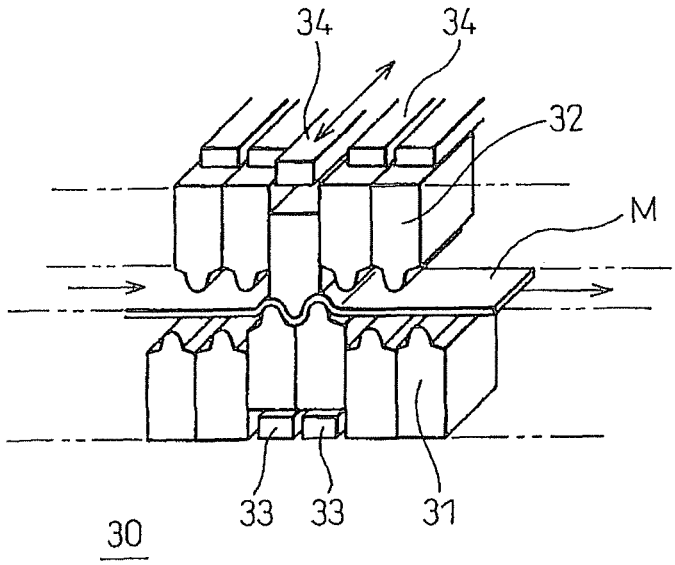
FIG. 5 is a schematic perspective view showing relevant portions for carrying out a method of a bending process according to a third embodiment of the present invention.

A processing machine 30 of a third embodiment is shown in FIG. 5.

The processing machine 30 has multiple first and second press punches 31 and 32, which are respectively arranged in the direction of the movement of the material (the thin metal plate) M. Each of the press punches 31 and 32 extends in the direction perpendicular to the direction of the movement of the material M and has a length almost equal to a width of the material M. A forward end of each press punch 31 and 32 is directed toward the material M. Each of the press punches 31 and 32 is movable toward the material M in a vertical direction in the drawing. Each of the first press punches 31 is displaced from each of the second press punches 32 in the direction of the movement of the material M by a half pitch, so that a processing concave surface portion and a processing convex surface portion are formed between opposing forward ends of the first and second press punches 31 and 32. Multiple first and second cam members 33 and 34 are respectively provided at the first and second press punches 31 and 32, wherein each of the first and second cam members 33 and 34 is movable in a cam operating direction, which is perpendicular to the direction of the movement of the material M, that is a longitudinal direction of the press punches 31 and 32. When the cam member 33 or 34 is moved in the cam operating direction, the cam member 33 or 34 is engaged with the corresponding press punch 31 or 32 and then brought out of the engagement when the cam member is moved to its maximum stroke position.

Figure 6:
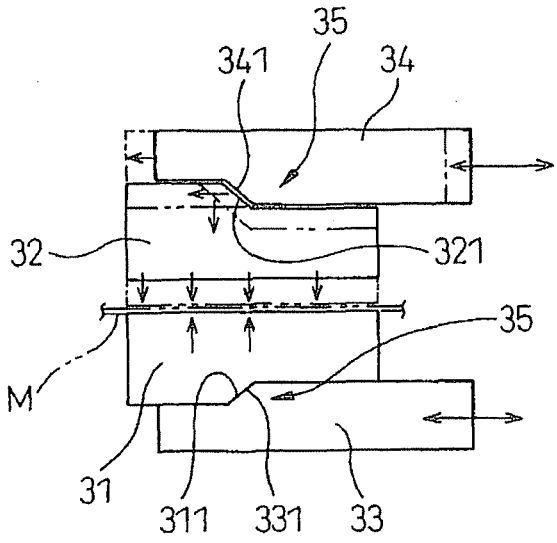
FIG. 6 is a schematic view showing the relevant portions (a press punch and a movable cam) of a machine shown in FIG. 5.
Figure 7:
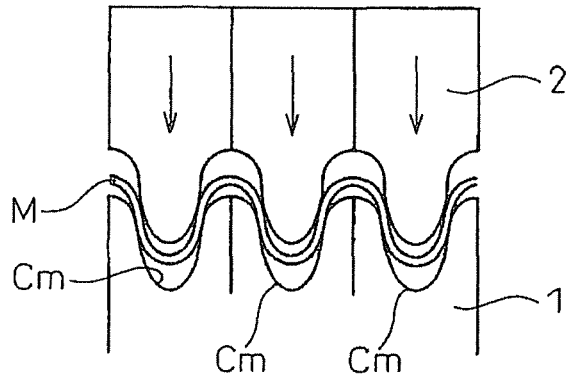
FIG. 7 PRIOR ART
FIG. 7 is a schematic view showing an example of a press work according to a prior art.
Figure 8:
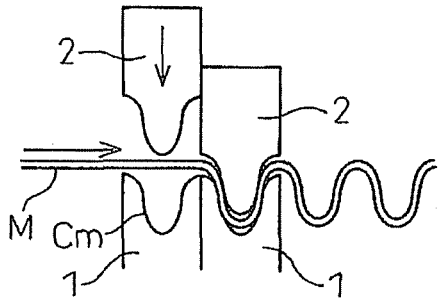
FIG. 8 PRIOR ART
FIG. 8 is a schematic view showing another example of a press work according to a prior art.
Figure 9:
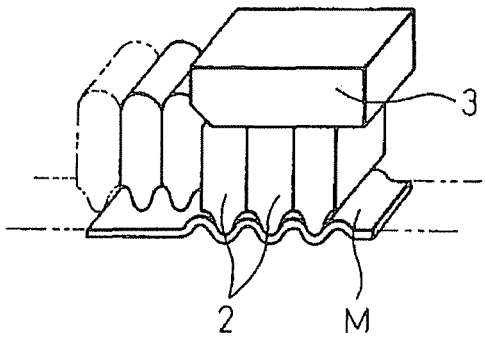
FIG. 9 PRIOR ART
FIG. 9 is a schematic perspective view showing a further example of a time-difference press work according to a prior art.
Figure 10:
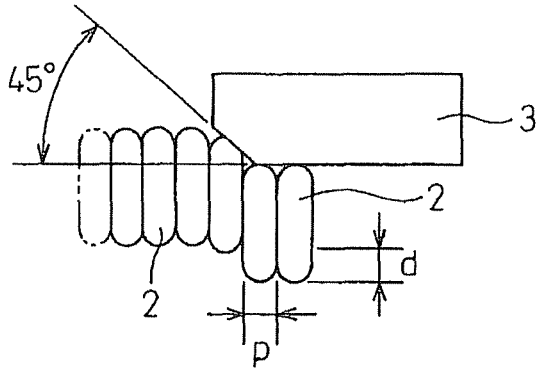
FIG. 10 PRIOR ART
FIG. 10 is a schematic side view showing relevant portions of a machine shown in FIG. 9.
Figure 11:
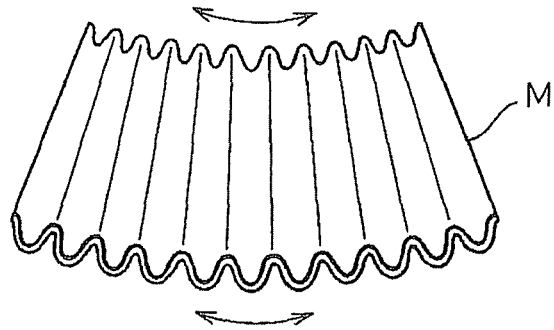
FIG. 11 PRIOR ART
FIG. 11 is a schematic panoramic view of a product, which is formed by a conventional press work but a shape of which is changed to a bowing shape.

As shown in FIG. 6, an inclined surface portion 331 is formed on an upper side of the first cam member 33, while an inclined surface portion 311 is formed on a lower side of the first press punch 31, wherein the inclined surface portion 331 is operatively brought into contact with the inclined surface portion 311 to form a first inclined engaging portion 35. In a similar manner, an inclined surface portion 341 is formed on a lower side of the second cam member 34, while an inclined surface portion 321 is formed on an upper side of the second press punch 32, wherein the inclined surface portion 341 is operatively brought into contact with the inclined surface portion 321 to form a second inclined engaging portion 35.

Each of the inclined surface portions 331 and 341 formed in the cam members 33 and 34 as well as each of the inclined surface portions 311 and 321 formed in the press punches 31 and 32 is inclined by almost 135 degrees from the cam operating direction.

In a similar manner to the second embodiment, a pair of concave portions may be formed in each of the press punches 31 and 32, while a pair of convex portions may be formed in each of the cam members 33 and 34, so that a pair of inclined engaging portions 35 may be respectively formed between the first press punches 31 and the first cam members 33 and between the second press punches 32 and the second cam members 34.

According to the above processing machine 30, the material (the thin metal plate) M is inserted into a space between the first and second press punches 31 and 32, and each of the first and second cam members 33 and 34 are sequentially moved back and forth in the cam operating direction (a width direction of the material M) at respective predetermined timings, so that two first press punches 31 neighboring to each other are lifted up while a corresponding second press punch 32 is downwardly moved. As a result, the material M is press worked and formed in a corrugated shape.

As above, the corresponding first press punch(es) 31 and second press punch(es) 32 are moved toward each other in a sequential manner to carry out the press work.

For example, as shown in FIG. 5, a center portion of the material M, which is inserted into the space between the first and second press punches 31 and 32, is at first press worked by the two neighboring first press punches 31 lifted up and one second press punch 32 pushed down. And then, the first and second press punches 31 and 32 neighboring to the center press punches 31 and 32 are sequentially and respectively lifted up and pushed down in rightward and leftward directions, so that the whole area of the material M is press worked to be formed in the corrugated shape.

According to the above manufacturing method, the tensility F (=Fb+Ff) is generated in the material M at both sides of the center press punches 31 and 32 in the rightward and leftward directions, so that the material M is pulled in at the both sides of the press punches 31 and 32 by the pull-in amount L. As above, the press work to the material M can be carried out at the same time at the both sides of the press punches 31 and 32 in a symmetric manner. As a result, a strain and a warp can be suppressed. A stable press work can be realized.

In the above embodiments, the press work may be carried out, for example, in two stages. When a portion of the material M, which has been press worked in a first stage, is restored to its original shape by its elasticity, the material M can be press worked in a second stage so that the shape of the material M finally becomes to a desired shape defined by the processing surface of the press punches. As a result, the product of a higher quality can be manufactured.

For example, the press work for the first embodiment shown in FIG. 2 may be carried out in the following steps: In a first step, a primary bending process (a primary press work) is carried out to the material M. Then, in a second step, the portion of the material M for which the primary press work has been done is fed to a next press-work operating position, which is a space between the press punch 12*b* and the block member 11*b* (the press punch and the block member of a second stage). The press punch and the block member of the second stage are neighboring to the respective press punch 12*b* and the block member 11*b* (the press punch and the block member of a first stage) which have carried out the above primary press work. In a third step, a secondary press work is carried out, by the press punch 12*b* and the block member 11*b* of the second stage, to the portion of the material M, for which the primary press work has been applied by the press punch 12*b* and the block member 11*b* of the first stage.

In case of the above press work of the two stages, the secondary press work may be applied to a first portion of the material M for which the primary press work has been done, and at the same time the primary press work is applied to a second portion of the material M which is next to the first portion of the material M, so that the corrugated shapes can be continuously formed by the two-stage press works.

In the above embodiments, the material M is sequentially fed to the press-work operating position between the press punch (the second die) 12*b*, 21 and the block member (the first die) 11*b*. However, multiple pairs of the first and second dies may be sequentially moved along the strip-shaped material M, each time when the press work will be done for another portion of the material M after the press work has been done for one portion of the material M, so that the press work can be also continuously carried out to the strip-shaped material M. In addition, a finishing press work may be applied to the material M, for which the press work has been done for one time.

The processing machine and/or the manufacturing method of the present invention should not be limited to such machine or method for manufacturing the product which is formed in the waveform, the processed surface of which has the predetermined curvature radius. The present invention may be applied to such a machine or method for manufacturing products having various kinds of corrugated shapes.

Furthermore, the present invention may be applied to a manufacturing method and/or apparatus for an off-set type corrugated fin, in which multiple fin portions are formed in each extending line of a corrugated fin and some of the fin portions are off-set from the remaining fin portions.

What is claimed is:

1. A method for bending a material of a thin metal plate using a bending machine, the method comprising:

providing the bending machine with a first die unit including multiple first die portions, each of which has a forward end for a bending process and is neighboring to each other in a direction of movement of the material, the first die unit having an upstream-side first die portion and a downstream-side first die portion, providing the bending machine with a second die unit including multiple second die portions, each of which has a forward end for the bending process and is neighboring to each other in the direction of movement of the material, the second die unit having an upstream-side second die portion and a downstream-side second die portion, each of the first die portions being opposed to each of the second die portions to form an upstream-side pair of the first and second die portions and a downstream-side pair of the first and second die portions in the direction of movement of the material, each of the upstream-side and downstream-side pairs of the first and second die portions being sequentially operated so that at least one of the first and second die portions is relatively moved toward the other die portion, in order to continuously carry out the bending method so as to form the material in a corrugated shape, a first step feeding the material toward a press work area between the first and second die units;

a second step relatively moving the downstream-side second die portion toward the downstream-side first die portion to a lower-most position of the downstream-side second die portion in order to carry out the bending process to the material, which is fed to a press-work operating position between the downstream-side first and second die portions, a third step relatively moving the upstream-side second die portion toward the upstream-side first die portion to an intermediate position of the upstream-side second die portion and holding the upstream-side second die portion at the intermediate position during the second step, so as to form a clearance between the forward end of the downstream-side first die portion and the forward end of the upstream-side second die portion, so that the clearance is located at a position before the press-work operating position for the bending method, wherein the material is in contact with the forward end of the upstream-side second die portion but distanced from the forward end of the downstream-side first die portion and the clearance is larger than a thickness of the material; and a pulling force of the material during the second and third steps is controlled by the clearance.

2. The bending method according to claim 1, further comprising:

carrying out a primary bending process to the material, before the step for feeding the material toward the press work area between the first and second die units.

3. A bending machine comprising:

a first and a second die unit opposing to each other for bending a material of a thin metal plate, the material being fed toward a press work area between the first and second die units;

the first die unit including multiple first die portions, each of which has a forward end for a bending process and is neighboring to each other in a direction of movement of the material, the first die unit having an upstream-side first die portion and a downstream-side first die portion in the direction of movement of the material, the second die unit including multiple second die portions, each of which has a forward end for the bending process and is neighboring to each other in the direction of movement of the material, the second die unit having an upstream-side second die portion and a downstream-side second die portion in the direction of movement of the material, each of the first die portions being opposing to each of the second die portions to form an upstream-side pair of the first and second die portions and a downstream-side pair of the first and second die portions in the direction of movement of the material, and each of the upstream-side and downstream-side pairs of the first and second die portions being sequentially operated so that at least one of the first and second die portions is relatively moved toward the other die portion, in order to continuously carry out the bending process so as to form the material in a corrugated shape, wherein the bending machine further comprises;

a material feeding portion for feeding the material toward the press work area between the first and second die units;

a downstream-side die-operating portion for moving the downstream-side second die portion toward the downstream-side first die portion to a lower-most position of the downstream-side second die portion in order to carry out the bending process to the material, which is fed to a press-work operating position between the downstream-side first and second die portions; and an upstream-side die-operating portion for moving the upstream-side second die portion toward the upstream-side first die portion to an intermediate position of the upstream-side second die portion and holding the upstream-side second die portion at the intermediate position during the bending process by the downstream-side die-operating portion, in order to form a clearance between the forward end of the downstream-side first die portion and the forward end of the upstream-side second die portion, so that the clearance is located at a position before the press-work operating position for the bending process and to control a pulling force of the material during the bending process, wherein the material is in contact with the forward end of the upstream-side second die portion but distanced from the forward end of the downstream-side first die portion during the bending process by the downstream-side die-operating portion, and the clearance is larger than a thickness of the material.

4. A method for bending a material of a thin metal plate using a bending machine, the method comprising:

providing the bending machine with a first die unit including multiple first cam members and multiple first press punches, the first press punches being neighboring to each other and straightly arranged in a longitudinal direction of the material, each of the first cam members being operatively brought into and out of engagement with each of the first press punches, so that the first press punch is moved toward the second die unit when the first cam member is operated, providing the bending machine with a second die unit including multiple second cam members and multiple second press punches, the second press punches being neighboring to each other and straightly arranged in the longitudinal direction of the material, and each of the second cam members being operatively brought into and out of engagement with each of the second press punches, so that the second press punch is moved toward the first die unit when the second cam member is operated, feeding the material toward a press work area between the first and second die units; and sequentially operating the respective first and second cam members of the first and second die units in a cam operating direction, which is perpendicular to the longitudinal direction of the material, so that the respective press punches are sequentially pushed to each other in a punch operating direction, which is perpendicular to a plane of the material, in order to continuously carry out the bending process to the material and to thereby form the material in a corrugated shape, wherein, in the step of sequentially operating the respective first and second cam members of the first and second die units in the cam operating direction, first and second center cam members, which are respectively arranged in a center of the straightly arranged first and second cam members, are operated at first, and first and second cam members neighboring to and arranged at both sides of the first and second center cam members are sequentially operated in a symmetric manner.

* * * * *